US007325402B2

(12) United States Patent
Parker et al.

(10) Patent No.: US 7,325,402 B2
(45) Date of Patent: Feb. 5, 2008

(54) PILOT NOZZLE HEAT SHIELD HAVING CONNECTED TANGS

(75) Inventors: David Parker, Oviedo, FL (US); Rajeev Ohri, Winter Springs, FL (US); Plum Boonsuan, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 653 days.

(21) Appl. No.: 10/910,865

(22) Filed: Aug. 4, 2004

(65) Prior Publication Data

US 2006/0027232 A1 Feb. 9, 2006

(51) Int. Cl.
*F02C 7/22* (2006.01)

(52) U.S. Cl. ..... 60/740; 239/132

(58) Field of Classification Search ..... 60/740, 60/741, 742, 743, 746, 747, 752; 239/103, 239/132

See application file for complete search history.

(56) References Cited

U.S. PATENT DOCUMENTS 3,691,765 A 9/1972 Carlisle
4,322,945 A * 4/1982 Peterson et al. ..... 60/740
4,914,918 A * 4/1990 Sullivan ..... 60/756
5,233,824 A 8/1993 Clevenger
5,297,390 A 3/1994 Sood
5,423,178 A 6/1995 Mains
5,484,105 A 1/1996 Ausdenmoore et al.
5,974,805 A * 11/1999 Allen ..... 60/740
6,152,052 A 11/2000 Saxon et al.
6,289,677 B1 9/2001 Prociw et al.
6,295,801 B1 10/2001 Burrus et al.
6,560,964 B2 5/2003 Steinhorsson et al.
6,595,000 B2 7/2003 Lavie et al.

* cited by examiner

*Primary Examiner*—L. J. Casaregola

(57) ABSTRACT

A pilot nozzle heat shield includes a generally cylindrical body having a first end for receiving a pilot nozzle. The body includes a plurality of radial retention pin cavities for receiving retention pins. A frustoconical flow tip is located at a second end of the body that includes a proximal periphery and a distal periphery. A plurality of flow jets are circumferentially spaced about the proximal periphery of the frustoconical flow tip which further includes a plurality of slots extending distally from the plurality of flow jets. The plurality of slots define a plurality of tangs and the plurality of tangs define an aperture at the distal periphery of the flow tip. At least two of the tangs are connected about the distal periphery of the flow tip and the pilot nozzle heat shield generally includes at least two sets of connected tangs.

20 Claims, 6 Drawing Sheets

PILOT NOZZLE HEAT SHIELD HAVING CONNECTED TANGS

FIELD OF THE INVENTION

The invention relates in general to turbine engines and, more particularly, to a heat shield for a pilot nozzle.

BACKGROUND OF THE INVENTION

Turbine engines can be utilized for a number of purposes including propulsion and electricity generation. Because of the need to keep the turbine operating consistently with shortened periods of maintenance downtime, the state of the turbine engine art is constantly improving. To maintain the desired operating conditions in a turbine engine, one method of improving performance characteristics is by ensuring that the engine has sufficient combustion for operation.

In general, combustion flame in the combustion chamber of a turbine engine is facilitated by a series of fueled pilot nozzles which provide flame under pressure to the combustion chamber. Because of the volatile environment of the combustion chamber, i.e. extreme heat, pressure and vibration, unprotected pilot nozzles are subject to warping or clogging and the fuel passing therethrough is subject to coking. Such warping or clogging of the pilot nozzle results in a dramatic decrease in the efficiency with which the pilot nozzle operates as well as the combustion facilitated thereby.

Inefficient combustion results in a significant increase in operating costs in a number of ways, including increased fuel consumption, a loss in the amount of power the turbine produces and increased nitrogen oxide emissions. Nitrogen oxides (NOx) are classified as criteria pollutants by the EPA and are frequently created through high temperature combustion. Facilities releasing NOx emissions are required to obtain and hold permits. Facilities releasing greater amounts of NOx emissions than allowed under permit can be subjected to fines or additional permitting requirements, thereby increasing costs.

To reduce the amount of heat to which pilot nozzles are subjected, efforts have been made to protect the pilot nozzle by various cooling arrangements. These cooling systems can include water jackets or heat shields that surround the pilot nozzle to provide it protection from the volatile environment of the combustion chamber. These prior art heat shields generally have suffered a number of problems including fuel flow obstruction and air flow obstruction. Efforts have been made to remedy these defects by providing a pilot nozzle heat shield having flow jets and tangs. These tangs are concentrically angled inward and separated to provide improved fuel flow characteristics, resulting in an increase in combustion efficiency. The separated tang heat shield has been a significant improvement over prior cooling systems, however, this design too suffers a number of problems.

One major problem of the separated tang heat shield is due to a bending or warping of the individual tangs. Because of the high heat, pressure, and vibration in the combustion chamber, this volatile environment, coupled with the flow of the fuel through the pilot nozzle, causes the individual tangs to bend outward, or twist from their ordinary position, thereby changing the overall shape of the heat shield. The change in the shape of the heat shield results in a disruption of the fluid air flow through the heat shield as well as a disruption in the fluid flow of the pilot fuel from the pilot nozzle. Once distorted, the resulting effect is a decrease in reliability and efficiency, resulting in engine down time for heat shield replacement.

Because heat shields are in an environment of intense heat, pressure and vibration, when installed, they are welded onto the pilot nozzle. As such, the need to remove and replace a heat shield that has effectively changed shape and performance characteristics, requires the heat shield to be ground or milled from its mount and replaced. Such a process can increase the amount of maintenance downtime as well as the monetary costs associated with maintaining the turbine engine.

SUMMARY OF THE INVENTION

Accordingly, there is a need to address the problems encountered in prior art pilot nozzles. Therefore, it is an object of the present invention to provide an improved pilot nozzle heat shield. More, specifically, there is a need for a pilot nozzle heat shield having connected tangs, resulting in a reduction of the incidence of heat shield failure and maintenance down time.

In an illustrative embodiment, a pilot nozzle heat shield can have a generally cylindrical body having a first end for receiving a pilot nozzle. The body can have a plurality of radial retention pin cavities for receiving retention pins. According to aspects of the invention, a flow tip can be located at a second end of the body. The flow tip can include a proximal periphery and a distal periphery. A plurality of flow jets can be circumferentially spaced about the proximal periphery of the flow tip. The flow tip can further include a plurality of slots extending distally from the plurality of flow jets. The plurality of slots can define a plurality of tangs, and the plurality of tangs can collectively define an aperture at the distal periphery of the flow tip. At least two of the tangs can be connected about the distal periphery of the flow tip. In addition, the pilot nozzle heat shield generally can have at least two sets of such connected tangs.

In a further embodiment, the pilot nozzle heat shield has slots between any two connected tangs. The slots extend distally to a stress relief hole that is preferably located proximal to the aperture. The stress relief hole prevents the tangs from cracking or breaking apart due to the bending or torquing of the tangs caused by the volatile environment of the combustion chamber.

The pilot nozzle heat shield, for example, can be manufactured from a heat resistant weldable alloy. Such a weldable alloy can contain numerous elements. For example, a weldable alloy consistent with aspects of the present invention can include iron and at least two other materials selected from the group consisting of: aluminum; boron; carbon; chromium; cobalt; copper; manganese; molybdenum; nickel; phosphorus; silicon; sulfur; titanium; and tungsten.

In another embodiment, the pilot nozzle heat shield can have tangs that angle concentrically inward at an angle between about twenty-five degrees (25°) and about sixty-five (65°) degrees. The heat shield can be used in a turbine engine that is fueled by gas, oil or a dual fuel system.

For attachment to the pilot nozzle, the heat shield can have an internal taper at the first end of the heat shield for receiving the pilot nozzle. The heat shield can also have between three and four retention pin cavities for receiving retention pins for mounting to the pilot nozzle. The retention pin cavities can be located circumferentially about the periphery of the heat shield. In a further embodiment, the retention pin cavities can be reinforced by an annular ring of additional heat resistant alloy material disposed about the periphery of the heat shield.

Further objects and advantages of the present invention will become apparent by reference to the following detailed disclosure of embodiments according to aspects of the invention and appended drawings wherein like reference numerals refer to the same feature, component or element.

DETAILED DESCRIPTION OF EMBODIMENTS OF THE INVENTION

Figure 1:
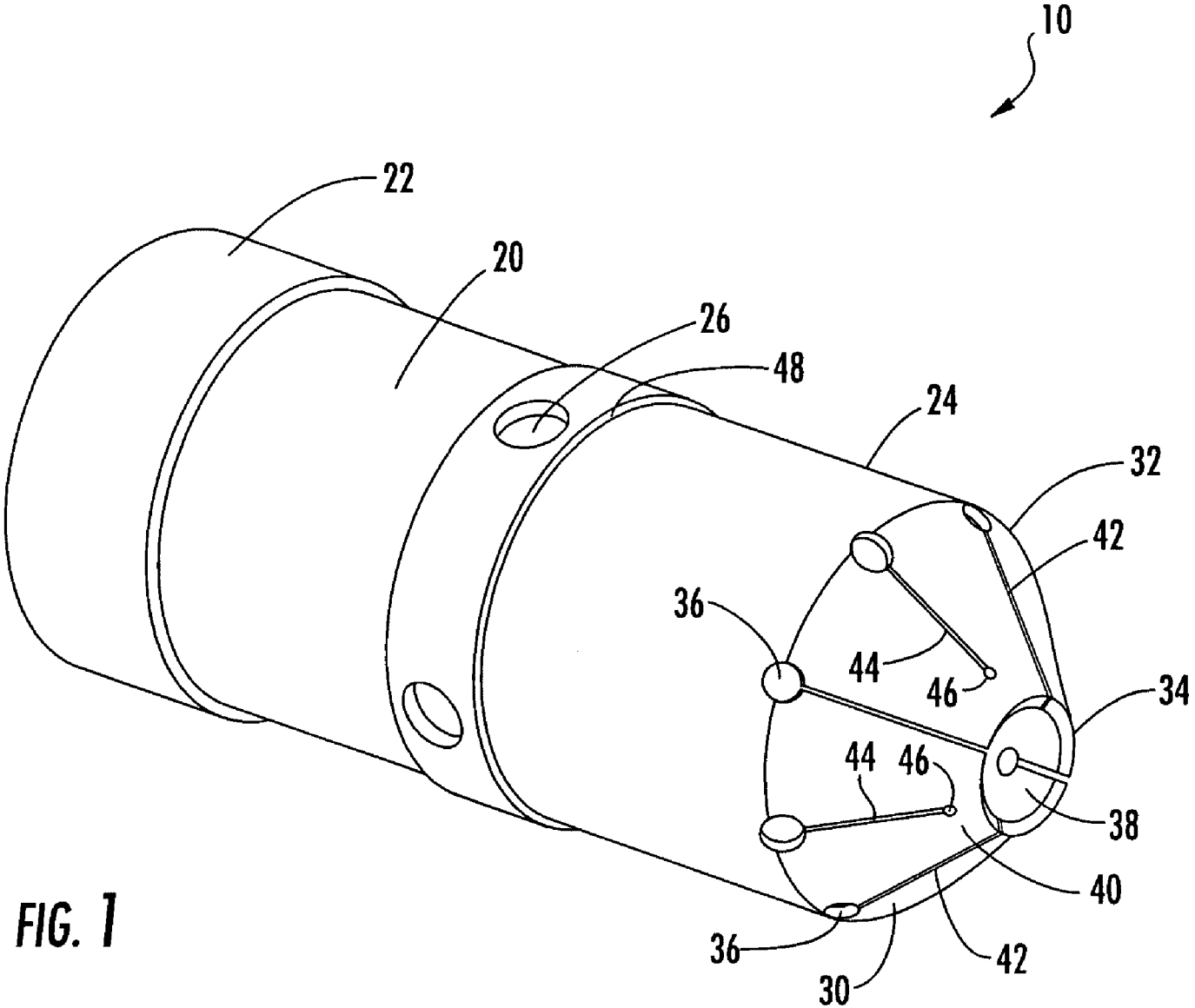
FIG. 1 is a perspective view of a pilot nozzle heat shield embodiment according to aspects of the present invention.

Referring now to FIGS. 1-6, an exemplary pilot nozzle heat shield according to aspects of the present invention is illustrated and generally referred to by reference numeral 10.

The heat shield 10 has a body 20. The body 20 is generally cylindrical in shape and comprises a first end 22, a second end 24 and a series of retention pin cavities 26 therebetween. The heat shield 10 can be milled out of a solid piece of heat resistant alloy or cast from the same or similar material. The body 20 is of sufficient size to internally receive the pilot nozzle P (See FIG. 2) and allow sufficient airflow between the pilot nozzle P and the inside of the body 20. The first end 22 of the body 20 can have an internal taper 28 to provide improved air flow through the heat shield 10. The heat shield 10 is the main source of heat protection for the pilot nozzle P. The air flowing through the heat shield can operate to decrease the temperature of the heat shield 10 and can act as an additional buffer between the heat shield 10 and the pilot nozzle P. The cooling of the heat shield 10 can reduce the amount of damage caused by the intense heat in the combustion chamber thereby increasing the usable life of the heat shield 10. The cooling of the pilot nozzle P can also increase the usable life of the pilot nozzle P, in addition to preventing fuel coking.

The retention pin cavities 26 are spaced circumferentially about the periphery of the body 20 and are of sufficient size to receive retention pins 50. By way of example, the retention pins 50 can be manufactured from a weldable material such as stainless steel or a material similar to that from which the heat shield 10 is manufactured. The retention pins 50 can be any type of pin manufactured from a weldable material with sufficient strength to maintain position of the heat shield around the pilot nozzle P. By way of example, the retention pins 50 can be 300 series stainless steel split-pins.

When the pilot nozzle P is inserted into the first end 22 of the body 20, the heat shield 10 is held into place on the pilot nozzle P by the retention pins 50. The retention pins 50 are, for example, welded into place by conventional techniques so that the vibration forces in the combustion chamber (not shown) do not jar the heat shield 10 loose from the pilot nozzle P. Because the retention pins 50 are welded to the body 20 of the heat shield 10 at the retention pin cavities 26, the retention pins 50 must be milled or ground out of the body 20 in order to replace the heat shield 10.

Due to the location of the retention pins 50, there is an inherent obstruction of the airflow between the heat shield 10 and the pilot nozzle P. Accordingly, it is preferable to have a sufficient number of retention pins 50 to maintain the heat shield 10 in the proper position around the pilot nozzle P without causing substantial airflow obstruction between the body 20 of the heat shield 10 and the pilot nozzle P. While the heat shield 10 can be retained by as few as two opposing retention pins 50, the vibrational forces in the combustion chamber can cause the heat shield 10 to pivot about the axis of the two opposing retention pins 50, thereby causing further obstruction of the airflow through the heat shield 10 and resulting in an inefficient pilot burn.

By way of example, to properly maintain the position of the heat shield 10 around the pilot nozzle P while reducing obstruction of the airflow through the heat shield 10, between three and four retention pins 50 preferably can be used to maintain the position of the heat shield 10 around the pilot nozzle P. More than four retention pins 50 can result in substantial obstruction in the airflow through the heat shield 10, resulting in an inefficient pilot burn and an increase in operating costs.

Because the retention pins 50 are utilized to maintain the position of the heat shield 10 around the pilot nozzle P, they are preferably mounted in a manner to provide sufficient structural strength and maintain the integrity and position of the heat shield 10. To provide additional strength to the retention pins 50 mounted in the body 20 of the heat shield 10, an annular ring 48 can be included around the periphery of the body 20 at the location of the retention pin cavities 26. In one embodiment, the annular ring 48 can be manufactured from additional material milled or cast circumferentially around the radial retention pin cavities 26. In another embodiment, the annular ring 48, can have retention pin cavities 26 passing therethrough and be manufactured from a weldable heat resistant material and connected to the body 20 by conventional means.

At the second end 24 of the body 20 of the heat shield 10, there can be a frustoconical flow tip 30. The frustoconical flow tip 30 can have a proximal periphery having a plurality of radial flow jets 36 passing therethrough. The term "flow jet" as used herein is defined as a hole or opening located at or near the proximal periphery 32 of the frustoconical flow tip 30, through which air or fuel can pass. The flow tip 30 can further include at least one dead-end slot 44 extending from one of the flow jets 36 and terminating on the flow tip 30 proximal to the aperture 38. The dead-end slot 44 can define connected tangs 40 adjacent thereto. The flow tip 30 can further include a plurality of through slots 42. Each one of the through slots 42 can extend distally from one of the plurality of flow jets 36 to the aperture 38, thereby defining sets of connected tangs 40 therebetween. Preferably, the heat shield 10 can have at least two sets of connected tangs 40 on the flow tip 30.

Figure 2:
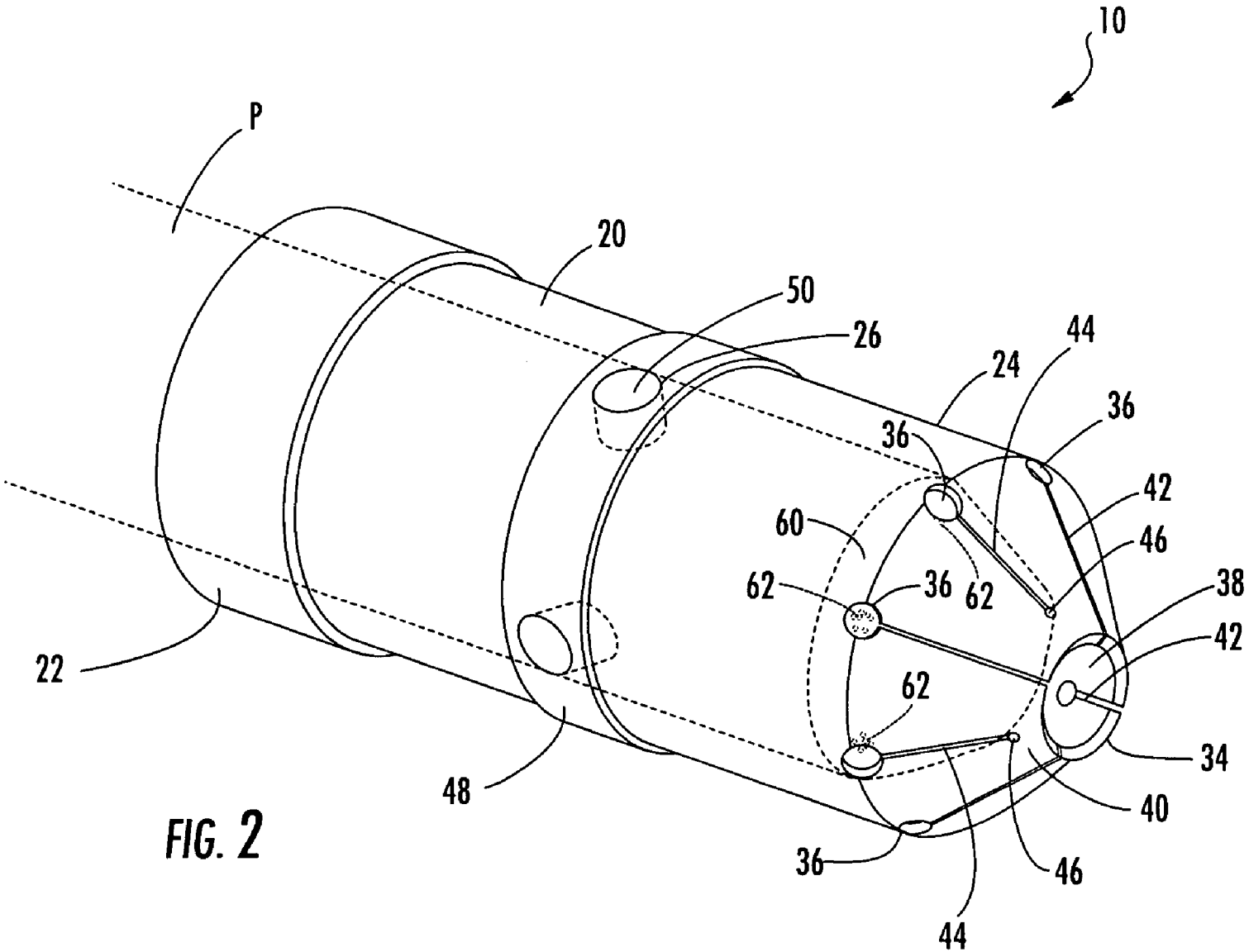
FIG. 2 is an in situ perspective view of a pilot nozzle heat shield embodiment according to aspects of the present invention with an internal view illustrating the location of a gas-only pilot nozzle attached inside the heat shield.
Figure 3:
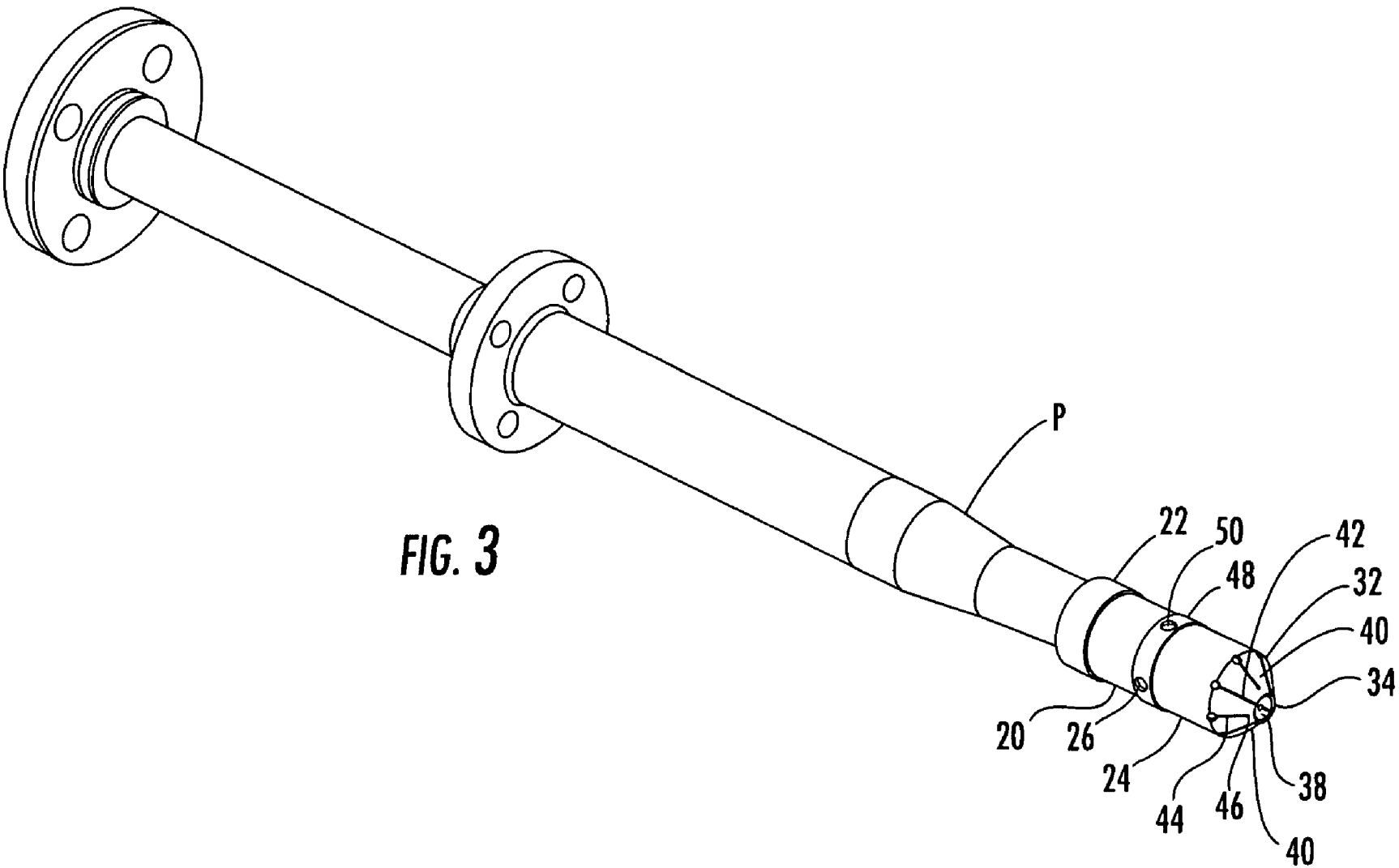
FIG. 3 is a perspective view of a gas-only pilot nozzle with an attached heat shield embodiment according to aspects of the present invention.
Figure 4:
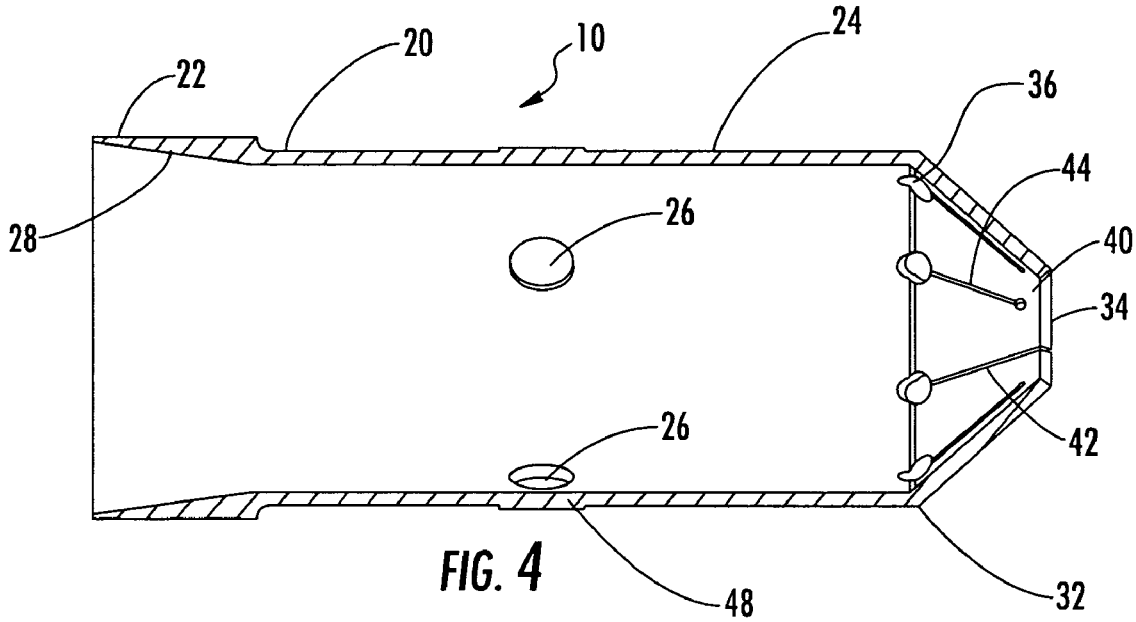
FIG. 4 is a side plan cutaway view of a pilot nozzle heat shield embodiment according to aspects of the present invention.
Figure 5:
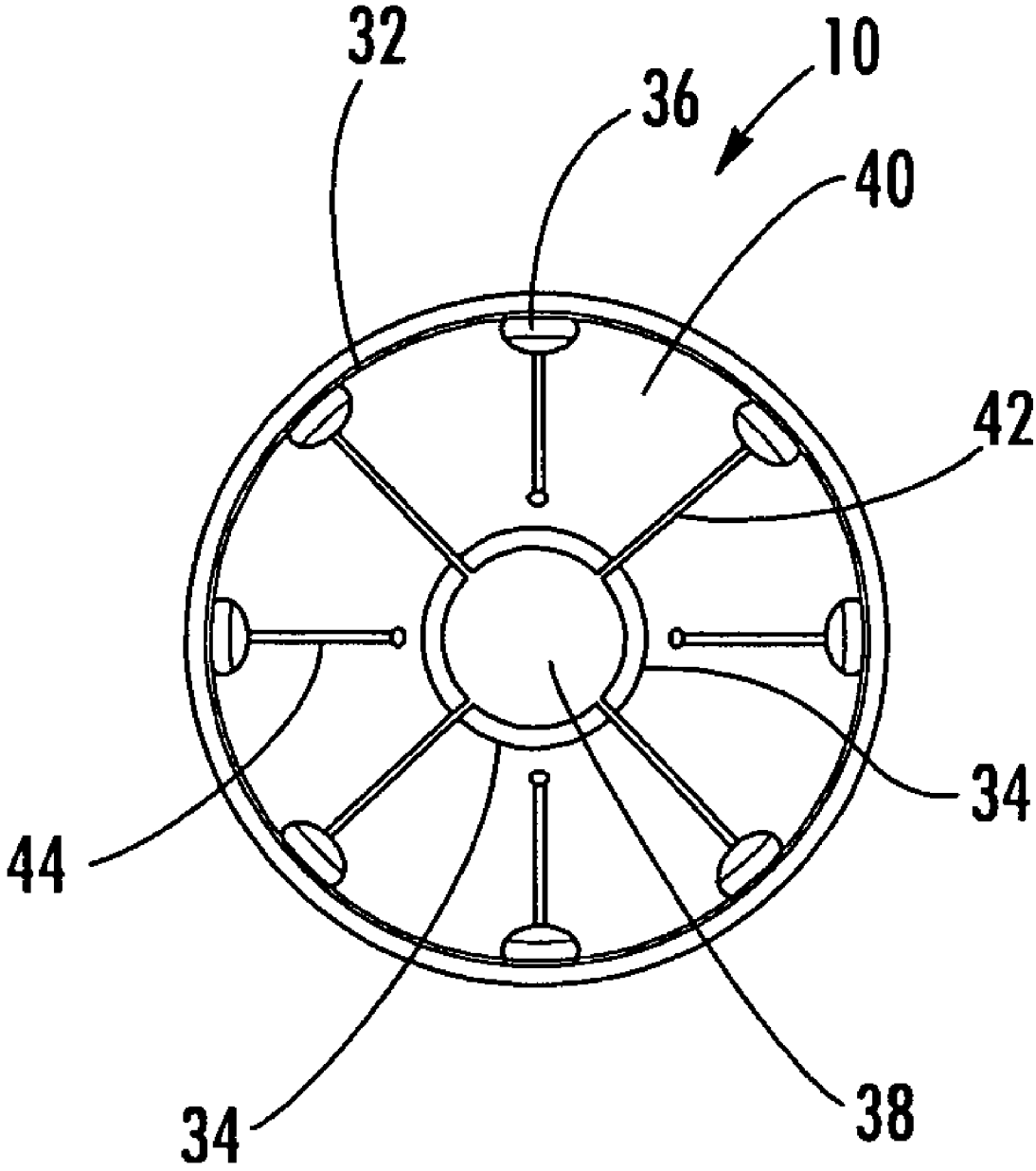
FIG. 5 is a front plan view of a pilot nozzle heat shield embodiment according to aspects of the present invention.
Figure 6:
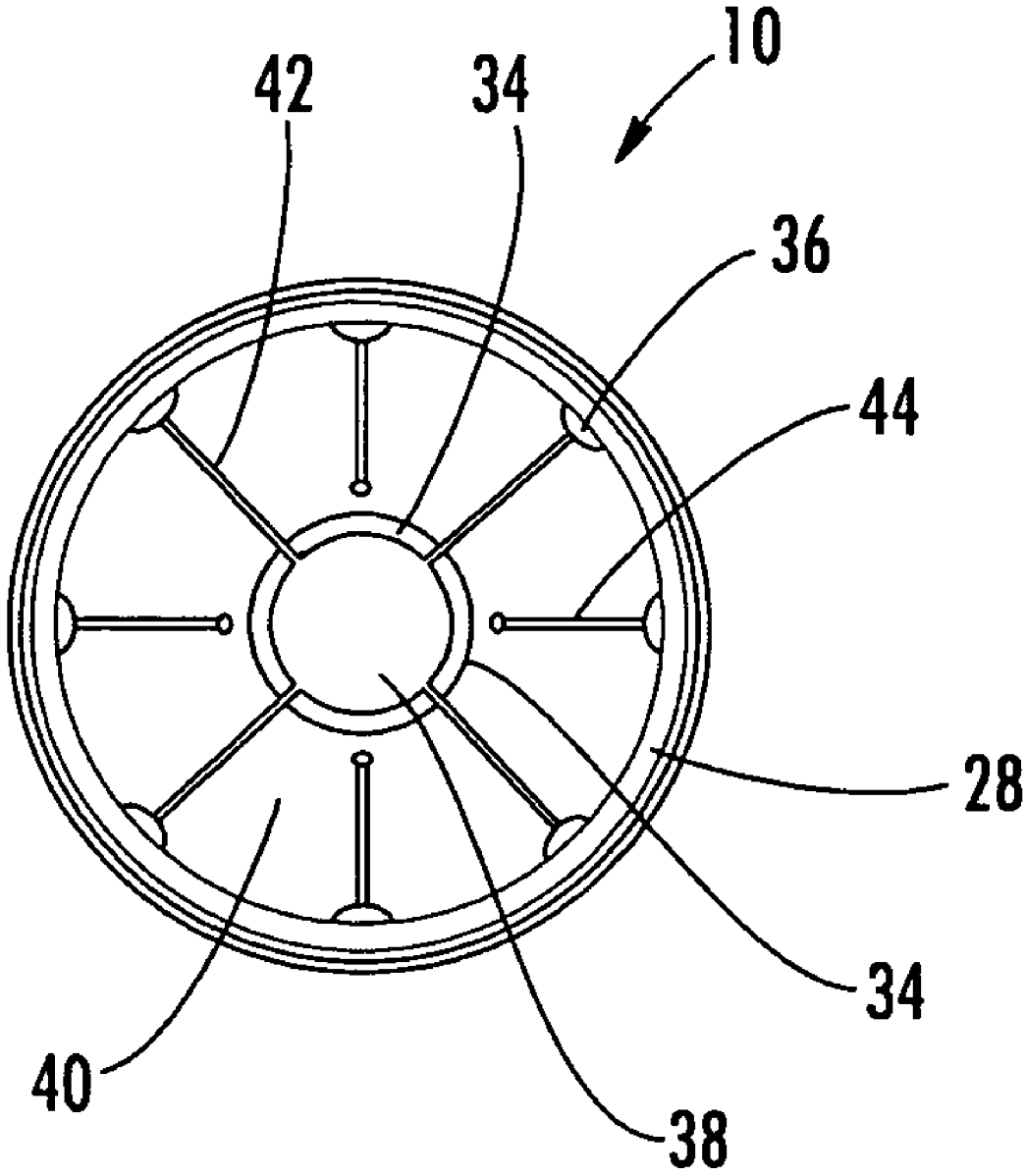
FIG. 6 is a rear plan view of a pilot nozzle heat shield embodiment according to aspects of the present invention.

Referring to FIG. 2, in a gas only system, the pilot nozzle P can comprise a face 60 having a plurality of fuel jets 62. Each flow jet 36 of the heat shield 10 can be located adjacent to a fuel jet 62 on the face 60 of the pilot nozzle P. Such placement of the flow jets 36 allows for the pilot fuel to pass out of the fuel jet 62 and through the flow jet 36, where it is ignited in the combustion chamber. As the fuel is forced out of the flow jets 36, air is drawn into and through the heat shield 10 where it exits the heat shield 10 through the aperture 38. Aperture 38 is defined at the proximal end 32 of the flow tip 30 collectively by sets of connected tangs 40.

In a dual-fuel system, where oil is utilized to fuel the pilot flame, the pilot nozzle P comprises a fuel tip (not shown) that extends through and past the aperture 38. As the pilot fuel, generally oil, is ignited at the fuel tip of the pilot nozzle P, the flow of combusted fuel draws air through the heat shield 10 where it exits the heat shield 10 through the flow jets 36 and the aperture 38.

Due to the intense heat, pressure and vibration to which the heat shield 10 is subjected, a stress relief hole 46 can be inserted at the distal end of the dead-end slot 44 thereby defining the terminus of the dead-end slot. The stress relief holes 46 are preferably of sufficient size to prevent cracking or separation of the tangs 40 due to bending or warping caused by the intense heat, pressure and vibration in the combustion chamber. The stress relief holes 46, however, are preferably small enough not to substantially interfere with the airflow passing through the heat shield 10.

The tangs 40 can be angled concentrically inward at an angle between about twenty-five degrees (25°) and about sixty-five degrees (65°). The tangs 40 terminate at the distal periphery 34 of the frustoconical flow tip 30, thereby defining an aperture 38 through which air and pilot fuel can exit the heat shield 10.

In a further embodiment, the heat shield 10 can be utilized on gas turbine or other turbine engines, such as, for example, dual fuel turbine engines, where oil and gas are utilized to operate the turbine.

In another embodiment, the heat shield is manufactured from a highly heat resistant alloy, such as Hastelloy X, Altemp HX, Nickelvac HX, Nicrofer 4722 Co, Pyromet Alloy 680 or any other alloy having iron and at least two other elements selected from the group consisting of aluminum, boron, carbon, chromium, cobalt, copper, manganese, molybdenum, nickel, phosphorus, silicon, sulfur, titanium, and tungsten.

Following are examples illustrating procedures for practicing aspects of the invention. These examples should not be construed as limiting, but should include any and all obvious variations as would be readily apparent to a skilled artisan.

In a gas-only turbine, the pilot nozzle heat shield 10 is mounted to the pilot nozzle P by between three and four retention pins 50. As pilot fuel passes through fuel jets 62 on the face 60 of the pilot nozzle P, it exits through the flow jets 36 located at the proximal periphery 32 of the frustoconical flow tip 30 of the second end 24 of the body 20 of the heat shield 10 and ignites in the combustion chamber of the turbine. The pilot fuel, under pressure, is forced out of the flow jets 36 of the frustoconical flow tip 30, drawing air through the first end 22 of the body 20 of the heat shield 10. The drawn air operates to cool the pilot nozzle heat shield 10 and further operates to buffer the pilot nozzle P from excessive heat. The cooling air then exits the heat shield 10 through the aperture 38.

In another example, the heat shield 10 is mounted to a pilot nozzle P in a dual-fuel turbine by between three and four retention pins 50. The pilot nozzle P comprises a fuel tip (not shown) that extends through and past the aperture 38. As the pilot fuel, generally oil, is ignited at the fuel tip of the pilot nozzle P, the flow of combusted fuel draws air through the first end 22 of the body 20 of the heat shield 10. The drawn air operates to cool the pilot nozzle heat shield 10 and further operates to buffer the pilot nozzle P from excessive heat. The cooling air then exits the heat shield 10 through the flow jets 36 and the aperture 38.

When used in accordance with the teachings set forth herein, the heat shield 10 can protect and maintain the integrity of the pilot nozzle P thereby resulting in a reduction in the NOx emissions from the turbine. The amount of NOx emissions can be reduced by between about 0.5 ppm and 1.5 ppm. Such a reduction in NOx emissions, can result in significant cost savings for users.

Inasmuch as the preceding disclosure presents the best mode devised by the inventor for practicing the invention and is intended to enable one skilled in the pertinent art to carry it out, it is apparent that structures and methods incorporating modifications and variations will be obvious to those skilled in the art. As such, it should not be construed to be limited thereby but should include such aforementioned obvious variations and be limited only by the spirit and scope of the following claims.

We claim:

1. A pilot nozzle heat shield comprising:

a heat shield body having a first end for receiving a pilot nozzle and an opposite, second end;

a flow tip at the second end of said body, said flow tip including a proximal periphery at the second end and a distal periphery defining an aperture, a plurality of flow jets spaced about the proximal periphery of said flow tip, said flow tip further including at least one dead-end slot extending from one of the flow jets and terminating on the flow tip proximal to the aperture, thereby defining connected tangs adjacent to said dead-end slot, said flow tip further including a plurality of through slots, each through slot extending distally from one of said plurality of flow jets to said aperture, said through slots defining sets of connected tangs therebetween, wherein at least two sets of connected tangs are provide on said flow tip.

2. The pilot nozzle heat shield of claim 1 wherein one of said dead-end slots between two connected tangs extends distally to a stress relief hole located proximal to the aperture.

3. The pilot nozzle heat shield of claim 1 wherein said heat shield is manufactured from a heat resistant weldable alloy.

4. The pilot nozzle heat shield of claim 3 wherein said weldable alloy comprises iron and at least two other materials selected from the group consisting of: aluminum, boron, carbon, chromium, cobalt, copper, manganese, molybdenum, nickel, phosphorus, silicon, sulfur, titanium and tungsten.

5. The pilot nozzle heat shield of claim 1 wherein said tangs angle concentrically inward at an angle between about twenty-five degrees (25°) and about sixty-five (65°) degrees.

6. The pilot nozzle heat shield of claim 1 wherein said heat shield is used in a turbine engine.

7. The pilot nozzle heat shield of claim 6 wherein said turbine engine is a dual-fuel turbine engine.

8. The pilot nozzle heat shield of claim 1 wherein said heat shield body includes between three and four retention pin cavities.

9. The pilot nozzle heat shield of claim 8 wherein at least one of said retention pin cavities is reinforced by an annular ring of heat resistant alloy material disposed about the periphery of said heat shield.

10. The pilot nozzle heat shield of claim 1 wherein said first end has an internal taper for receiving said pilot nozzle.

11. A pilot nozzle heat shield for use in a gas turbine engine comprising:

a generally cylindrical body manufactured from a heat resistant weldable alloy comprising a first end for receiving a pilot nozzle, said body further comprising a plurality of retention pin cavities spaced circumferentially about the periphery of said body for receiving retention pins; and a frustoconical flow tip at a second end of said body, said frustoconical flow tip comprising a proximal periphery and a distal periphery defining an aperture and further comprising a plurality of through slots, each extending distally from one of a plurality of flow jets circumferentially disposed about the proximal periphery of said frustoconical flow tip to said aperture, said through slots defining sets of connected tangs therebetween, each of said sets of connected tangs comprising at least one dead-end slot extending from one of said flow jets and terminating at a stress relief hole on the flow tip proximal to the aperture, wherein at least two of said sets of connected tangs are provided on the flow tip.

12. The pilot nozzle heat shield of claim 11 wherein said weldable alloy comprises iron and at least two other materials selected from the group consisting of: aluminum; boron; carbon; chromium; cobalt; copper; manganese; molybdenum; nickel; phosphorus; silicon; sulfur; titanium; and tungsten.

13. The pilot nozzle heat shield of claim 11 wherein said tangs angle concentrically inward at an angle between about twenty-five degrees (25°) and sixty-five (65°) degrees.

14. The pilot nozzle heat shield of claim 1 wherein said heat shield comprises between three and four retention pin cavities.

15. The pilot nozzle heat shield of claim 14 wherein said retention pin cavities are reinforced by an annular ring of heat resistant alloy material disposed about the periphery of said heat shield.

16. The pilot nozzle heat shield of claim 11 wherein said first end has an internal taper for receiving said pilot nozzle.

17. A pilot nozzle for use in a gas turbine engine comprising:

a pilot nozzle;

a heat shield manufactured from a weldable heat resistant alloy, further comprising a generally cylindrical body having an internal taper for receiving said pilot nozzle, said body further comprising four retention pin cavities spaced circumferentially about the periphery of said body for receiving retention pins and connecting said heat shield to said pilot nozzle; and a frustoconical flow tip at an end of said body, said frustoconical flow tip comprising a proximal periphery and a distal periphery defining an aperture and further comprising a plurality of through slots, each extending distally from one of a plurality of flow jets circumferentially disposed about the proximal periphery of said frustoconical flow tip to said aperture, said through slots defining sets of connected tangs therebetween, each of said sets of connected tangs comprising at least one dead-end slot extending from one of said flow jets and terminating at a stress relief hole on the flow tip proximal to the aperture, wherein at least two of said sets of connected tangs are provided on the flow tip.

18. The pilot nozzle of claim 17 wherein said weldable alloy comprises iron and at least two other materials selected from the group consisting of: aluminum, boron, carbon, chromium, cobalt, copper, manganese, molybdenum, nickel, phosphorus, silicon, sulfur, titanium and tungsten.

19. The pilot nozzle of claim 17 wherein said tangs angle concentrically inward at an angle between about twenty-five degrees (25°) and about sixty-five (65°) degrees.

20. The pilot nozzle of claim 17 wherein said retention pin cavities are reinforced by an annular ring of heat resistant alloy material disposed about the periphery of said heat shield.

* * * * *